US006260781B1

(12) United States Patent
Cooper

(10) Patent No.: US 6,260,781 B1
(45) Date of Patent: Jul. 17, 2001

(54) METHOD AND APPARATUS FOR PACKING WIRE IN A STORAGE DRUM

(75) Inventor: William D. Cooper, Chardon, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 0 days.

(21) Appl. No.: 09/449,826

(22) Filed: Nov. 26, 1999

Related U.S. Application Data

(63) Continuation of application No. 09/212,830, filed on Dec. 16, 1998, now Pat. No. 6,019,303.

(51) Int. Cl.[7] ..... B21C 47/10; B21C 47/02

(52) U.S. Cl. ..... 242/361.4; 242/362

(58) Field of Search ..... 242/361.1, 361.4, 242/361.5, 362, 362.2

(56) References Cited

U.S. PATENT DOCUMENTS

| | | | | |
|---|---|---|---|---|
| 2,722,729 | * | 11/1955 | Wilhelm | 242/362 X |
| 2,959,279 | * | 11/1960 | Krafft et al. | 242/361.4 X |
| 3,061,229 | * | 10/1962 | Crum | 242/361.5 X |
| 3,120,931 | | 2/1964 | Lorenz . | |
| 3,235,202 | | 2/1966 | Kitselman . | |
| 3,270,977 | | 9/1966 | Tillou . | |
| 3,362,654 | | 1/1968 | Kitselman . | |
| 3,445,077 | * | 5/1969 | Cole et al. | 242/361.4 |
| 3,703,261 | | 11/1972 | Cofer et al. . | |
| 3,776,519 | | 12/1973 | Hamilton . | |
| 3,971,521 | * | 7/1976 | Crotti | 242/361.4 |
| 5,277,314 | | 1/1994 | Cooper . | |
| 5,374,005 | * | 12/1994 | Jenkins et al. | 242/361.4 |
| 5,806,780 | * | 9/1998 | Schneider et al. | 242/419 |
| 6,019,303 | * | 2/2000 | Cooper | 242/361.4 |

FOREIGN PATENT DOCUMENTS 2 059 462 * 4/1981 (GB) .

* cited by examiner

*Primary Examiner*—Michael R. Mansen
(74) *Attorney, Agent, or Firm*—Vickers, Daniels & Young

(57) ABSTRACT

A densely packed storage drum containing wire, and a method and apparatus for producing the same. The storage drum having an interior storage cavity into which wire is fed. The drum is supported on a turn table adapted to rotate and index the storage drum relative to a rotatable laying head which guides the wire into the drum. A capstan turning at a set rotational velocity pulls the wire and delivers the wire into the rotating laying head. As the laying head feeds the wire into the storage drum the difference in the rotational velocities of the capstan and laying head causes the formation of loops of wire in the storage drum. By varying the relative velocities of the capstan and the laying head, and rotating and indexing the storage drum relative to the laying head the wire can be deposited into the drum in layers, with each layer having a plurality of loops of a specified diameter circumferentially and eccentrically positioned about the interior cavity of the drum. Adjacent layers having different loop diameters and circumferential positions, producing a densely packed storage drum filled with wire having a uniform radial density.

34 Claims, 11 Drawing Sheets

16.5" COIL 16.5" COIL SINGLE 15.5" COIL 15.5" COIL SINGLE

20" DRUM

23" DRUM

METHOD AND APPARATUS FOR PACKING WIRE IN A STORAGE DRUM

This patent application is a continuation of application Ser. No. 09/212,830 filed on Dec. 16, 1998, which issued as U.S. Pat. No. 6,019,303 and incorporated herein by reference.

The present invention relates to the art of packaging small diameter welding wire into a bulk storage container or drum and more particularly to densely packing welding wire in a storage drum to increase the amount of wire which occupies the storage drum without affecting the ultimate use of the product which is payed out from the container for mass production welding.

BACKGROUND OF THE INVENTION

Small diameter welding wire is typically packed in a large container in a single spool which has a natural "cast." This means that in the free state, the wire tends to seek a generally straight line condition. The invention will be described with particular reference to a natural cast type of welding wire stored as a large spool containing convolutions formed into layers of the welding wire. During use, the wire is ultimately payed out from the inside diameter of the spool through the upper portion of a container storing the spool.

When welding automatically or semi-automatically (including robotic welding), it is essential that the large amounts of welding wire be continuously directed to the welding operation in a non-twisted, non-distorted, non-canted condition so that the welding operation is performed uniformly over long periods of time without manual intervention and/or inspection. One of the difficult tasks in such welding is the assurance that the wire fed to the welding operation is fed in a non-twisted or low-twist condition so that the natural tendency of the wire to seek a preordained natural condition will not be detrimental to smooth and uniform welding. To accomplish this task, welding wire is produced to have a natural cast, or low-twist condition. This means that if a portion of the wire were cut into a long length and laid onto a floor, the natural shape assumed by the welding wire would be a generally straight line. This welding wire is wrapped into a spool in a large container (normally a drum) containing several hundred pounds of wire for automatic or semi-automatic welding. The natural tendency of the wire to remain in a straight or non-twisted condition makes the wire somewhat "live" when it is wrapped into the unnatural series of convolutions during placement in the container, resulting in distorting the wire from its natural state. For that reason, there is a tremendous amount of effort directed to the concept of placement of the wire within the container in order that it can be payed out to an automatic or semi-automatic welding operation in a low-twist condition. If the wire is not loaded correctly within the container, massive welding operations, which can consume a large amount of welding wire and a substantial amount of time, can be non-uniform and require expensive reprocessing. This problem must be solved by the manufacturers of welding wire, since they package the welding wire in the large spools which are intended to be payed out for the automatic or semi-automatic welding.

In recent years, there has been a trend toward even larger packages with a larger stock of welding wire. The large packages are intended to reduce the time required for replacement of the supply container at the welding operation. The increased demand for ever-larger supply containers is contrary to and further reduces the ability to smoothly withdraw the welding wire without disturbing the natural flow of the welding wire or twisting the welding wire with adjacent convolutions. Thus, a large volume high capacity storage supply container for welding wire spools must be constructed so that it assures against any catastrophic failure in the feeding of a wire to the welding operation. The pay-out or withdrawing arrangement of the container must be assured that it does not introduce even minor distortions in the free straight flow of the welding wire to the welding operation. The first step in assuring that no minor distortions exist is placement of the welding wire within the container in a manner which will allow withdrawal of the wire from the container in the preferred state.

The welding wire stored in the supply container is in the form of a spool having multiple layers of wire convolutions laid from bottom to top. The inner diameter of the spool is substantially smaller than the diameter of the container. Due to the inherent rigidity of the welding wire itself, the convolutions forming the layers are continuously under the influence of a force which tends to widen the diameter of the convolutions. In order to account for this tendency, the welding wire is laid within the supply container in preferred loop diameters, the loop diameters being smaller than the inner diameter of the supply container. Typically, the loop diameter is at least 15% less than the inner diameter of the drum.

The welding wire is drawn from the manufacturing process and fed over a series of dancer rollers and pulled along by a capstan adjacent the storage container. From the capstan, the welding wire is fed into a rotatable laying head, which is generally a cylindrical tube having an opening at the bottom or along the cylinder adjacent to the bottom. The wire extends through the tube and out the opening, whereupon it is placed into the storage container.

The laying head extends into the storage container and rotates about an axis generally parallel to the axis of the storage container. The wire being fed into the laying head by the capstan is fed at a rotational velocity different than the rotational velocity of the laying head. The ratio between the rotational velocity of the laying head and the rotational velocity of the capstan determines the loop size diameter of the wire within the storage container. As the wire is laid within the storage container, the weight thereof causes the storage container to gradually move downward. As the storage container moves downward, the laying head continues to rotate, thus filling the storage drum to its capacity. The storage drum is incrementally rotated a fraction of one revolution for each full loop of welding wire placed within the storage drum. This causes a tangential portion of the welding wire loop to touch a portion of the inside diameter of the storage container, while the opposite side of the loop is spaced a distance from the side of the container. This is accomplished by moving the laying head off the center line of the storage container by one-half the difference between the loop diameter and the diameter of the storage container.

Accomplishment of this prior art method of loading a storage container is best shown in FIG. 6. This method of loading storage drums with welding wire is important to the effective withdrawal of the welding wire during the welding process. However, as can be seen from FIGS. 7 and 8, this process also results in a loose density packing of the welding wire within the storage container. Depending on the diameter used relative to the storage container, the wire has a higher density along the edge portion of the storage container versus the inside diameter of the spool itself adjacent the spool cavity. This is caused since more wire is placed along the edge portions of the container than is placed along the spool cavity. While the net effect results in welding wire being able to be pulled from the container without substantial problems of tangle or twist, the low density packing means that interruptions in the welding process are more frequent. There is, therefore, greater down time for the welding operation and greater labor costs, since replacement of the supply container at the welding operation and manual intervention in the welding operation is necessary.

SUMMARY OF THE INVENTION

The present invention advantageously provides an improved method and apparatus of densely packing welding wire in a storage container, which overcomes the disadvantages of the prior art method and apparatus arrangements.

More particularly in this respect, the invention is used to package more welding wire in smaller but more densely packed containers, without affecting the ability to smoothly withdraw welding wire during automatic or semi-automatic welding processes. The machine for densely packing welding wire comprises a capstan for pulling the welding wire from the manufacturing process, a rotatable laying head upon a first axis for receiving the wire from the capstan, and a turntable which supports a welding wire storage drum. The welding wire is packaged within the storage drum by rotating the laying head at a first rotational velocity and rotating the capstan at a second rotational velocity in order to determine the loop diameter. The turntable is rotated about an axis which, in a preferred embodiment, is parallel to the first axis, at a third rotational velocity. Generally, for each loop of welding wire placed within the storage drum, the turntable rotates a fraction of one revolution, thus causing only a small portion of the circumference of the loop to contact the inner surface of the storage drum. By rotating the turntable only a fraction of one revolution, it is ensured that a subsequent loop placed within the storage drum will contact the interior surface of the storage drum at a second position along the interior of the storage drum and adjacent the first position of the preceding loop. Importantly, an indexing apparatus allows the storage drum and rotatable laying head to be moved relative to the other in sequential steps during loading of the wire within the storage drum. Preferably an indexer is used which causes the rotatable laying head to place wire in the storage drum from a different position within the storage drum, many of the disadvantages of the prior art can be overcome. Specifically, welding wire can be placed more densely within the container by avoiding placement of the wire from the same axis of rotation within the container. The invention is even better enhanced by intermittently changing the loop diameter of the wire within the container in combination with the indexing step. The net effect is the production of striated layers of welding wire within the container, each layer having a maximum density at a different radial position within the container than the adjacent layer. The indexing step and/or the changing of loop diameter ensures that a container of welding wire is more densely packed than prior art arrangements and thus more welding wire is placed within the same volume container.

In a preferred method of the invention, a capstan for densely packing welding wire in a storage drum is provided above the storage drum and is rotated at a set rotation for pulling the welding wire from a manufacturing process. The laying head is provided on a first axis which is preferably perpendicular to the axis about which the capstan rotates. The laying head rotates at a rotational velocity different than the capstan. The ratio of the rotational velocity of the capstan versus the rotational velocity of the laying head determines the loop size placed within the storage drum. Wire is fed from the capstan to the laying head, the laying head being provided and inserted within the storage drum. The storage drum is supported on a turntable which rotates a fraction of a revolution for every singular full revolution of the laying head. The laying head and the turntable preferably rotate about parallel axes. Periodically as the loops are being placed, one of the wire drum and the laying head are caused to index from a first position to a second position longitudinally displaced from the first position and along the line generally perpendicular to the rotational axis of the turntable. In combination with the indexing step, the first or the second rotational velocity may also be changed, which changes the ratio and thus changes the loop size diameter being placed within the storage drum. Further, in accordance with a preferred embodiment, the indexing step includes moving the wire drum relative to the first axis as a function of the number of the rotations of the turntable. This advantageously provides the striated or layered effect within the container which allows for the dense packing.

It is thus an outstanding object of the present invention to provide a welding wire storage drum with a significantly greater amount of welding wire than disclosed by the prior art.

It is yet another object of the present invention is to provide a packaged welding wire storage drum which results in less down time and less labor requirements during automatic and semi-automatic welding processes.

Still another object of the present invention is to provide a welding wire storage drum capable of storing more welding wire in less space, thus requiring less warehouse space than heretofore available.

Yet another object of the present invention is to provide an apparatus for densely packing welding wire in a storage drum which results in more densely packed storage containers.

A further object of the present invention to provide a method for densely packing welding wire in a storage drum without affecting the ability to smoothly withdraw the welding wire during the welding process.

It is a further object of the present invention to reduce the down time and labor costs associated with changing welding wire storage drum containers during a welding process. These and other objects of the invention will become apparent to those skilled in the art upon reading and understanding the detailed description in the following section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF THE INVENTION

Figure 1:
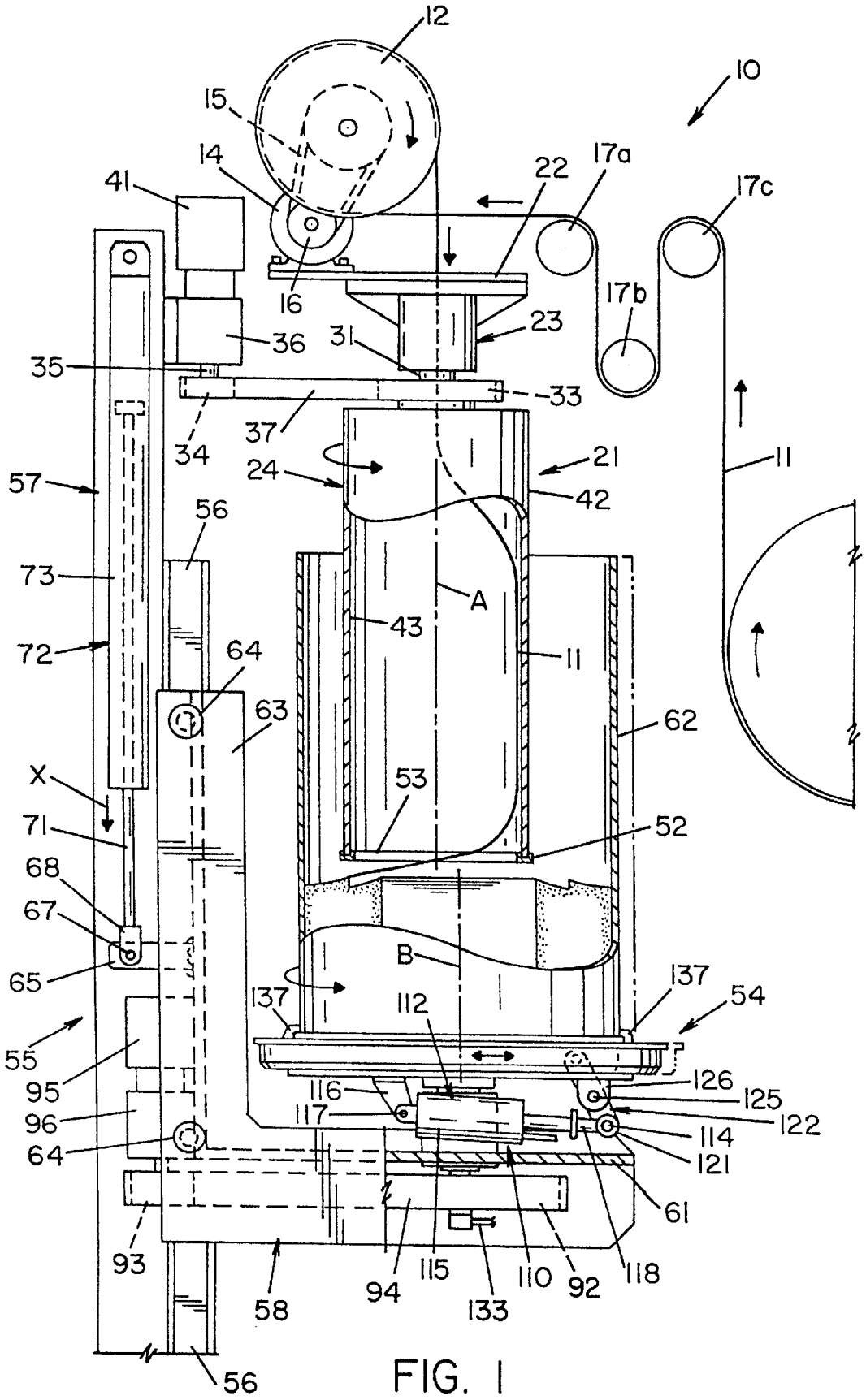
FIG. 1 is an elevation view illustrating the packaging system according to the present invention.

Referring to the drawings, wherein the showings are for the purpose of illustrating the invention only and not for the purpose of limiting same, FIG. 1 shows a drum winding system 10 which draws a continuous welding wire 11 from a manufacturing process (not shown). Welding wire 11 is drawn by a capstan 12 driven by a wire feed motor 14 connected to a pulley 16 which drives a belt 15. As can be seen, the wire is drawn over a series of rolls and dancer rolls 17*a*, 17*b* and 17*c* which serve to maintain tension to welding wire 11 between the manufacturing process and capstan 12. As can be seen from FIGS. 1 and 2B, welding wire 11 is wrapped about 270° about capstan 12. This provides proper friction and drive capacity to draw welding wire 11 across the dancer rolls 17*a*–17*c*. Welding wire 11 is fed into a rotatable laying head 21 which is suspended from a winding beam 22. Rotatable laying head 21 rotates within a bearing housing 23 which is suspended from winding beam 22. Rotatable laying head 21 includes a laying tube 24 and a journal portion 25 extending therefrom and supported for rotation by a flange 26 and a top and a bottom bearing 27 and 28 located at the top and bottom ends, respectively, of bearing housing 23. It will be appreciated that journal portion 25 includes both an outer cylindrical surface 31 for contact with bearings 27 and 28 and an inner cylindrical surface 32 defining a hollow shaft interior which allows welding wire 11 to pass from capstan 12 to laying tube 24.

A pulley 33 is keyed into the outer cylindrical surface 31 of journal portion 25 below bearing housing 23. A corresponding pulley 34 extends from a shaft 35 of a layer drive motor 36. A belt 37 connects pulleys 33 and 34 in order that layer drive motor 36 drives journal portion 25 and correspondingly drives rotatable laying head 21.

The control panel 41 directs the speed of layer drive motor 36 and wire feed motor 14 as well as coordinating the ratio between the speed of the two motors. The motor speed affects the rotational velocity of laying head 21 and the rotational velocity of capstan 12. It will be appreciated that the ratio between the laying head rotational velocity and the capstan rotational velocity determines a loop size diameter of welding wire 11 as will be described below.

Laying tube 24 includes an outer cylindrical surface 42, an inner cylindrical surface 43, and a generally closed upper end 44 having inner and outer surfaces 45 and 46, respectively. A small hole 47 centered about a centerline axis A of laying tube 24 extends between inner surface 45 and outer surface 46. The lower end of journal portion 25 extends through small hole 47, is supported by a small flange 51 at the extreme lower end of journal portion 25 and tack welded in place. The bottom end of laying tube 24 includes a ring 52 extending about the circumference of the lower end of laying tube 24. Ring 52 has an opening 53 through which welding wire 11 passes from laying tube 24 during the packing operation.

A turntable 54 is supported for rotation on a turntable support 55. Turntable support 55 includes a guide track 56, a force cylinder 57, and an L-shaped beam portion 58. As mentioned above, turntable support 55 allows rotation of turntable 54 thereupon, and specifically upon a horizontal beam 61 of L-shaped beam portion 58. It will be appreciated that as the weight of welding wire 11 is placed within storage drum 62, a vertical beam portion 63, which is attached to the rubber guide wheels 64, rides downward on guide track 56, which is shown as an H-beam. Thus, L-shaped beam portion 58 rides downward on guide track 56 while storage drum 62 is filled.

Vertical beam portion 63 includes a finger 65 which extends outwardly therefrom and is pivotally attached at pin 67 to an outward end 68 of a rod 71 which is part of a pressurized cylinder assembly 72. Pressurized cylinder assembly 72 includes a pressurized cylinder 73. It will be appreciated that cylinder 73 is pressurized such that when storage drum 62 is empty, cylinder 73 is at equilibrium and L-shaped beam portion 58 is at its highest point on guide track 56. As storage drum 62 is filled with welding wire 11, the additional weight placed on turntable 54 causes piston rod 71 to extend downward as shown by arrow X in a controlled descent down guide track 56. The pressure within cylinder 73 is based upon a predetermined weight to pressure ratio. The controlled descent allows welding wire 11 to be placed within storage drum 62 from the bottom of storage drum 62 adjacent turntable 54 to the top lip of storage drum 62. Thus, in the preferred embodiment, rotatable laying head 21 does not move in a vertical direction but instead turntable 54 moves in the vertical direction which is parallel to the centerline axis A of laying tube 24.

Turntable 54 is driven for rotation in a manner similar to laying tube 24. A bearing housing 84 is mounted on horizontal beam 61 of L-shaped beam portion 58. A journal portion 85 extends downwardly from turntable 54 and is allowed to freely rotate by means of the bearings 86 and 87. In accordance with the present invention, journal portion 85 is a cylinder which has an outer cylindrical surface 88 and an inner cylindrical surface 89 for purposes which will be described later. A cogbelt pulley 92 is keyed to the bottom end of journal portion 85. Cogbelt pulley 92 is connected to cogbelt pulley 93 by a belt 94. Cogbelt pulley 93 is driven by a turntable motor 95 through a gearbox 96. Turntable motor 95 is geared down substantially from laying tube 24 in order than turntable 54 only rotates one fraction of a single revolution relative to a full revolution of laying tube 24.

Figure 2A:
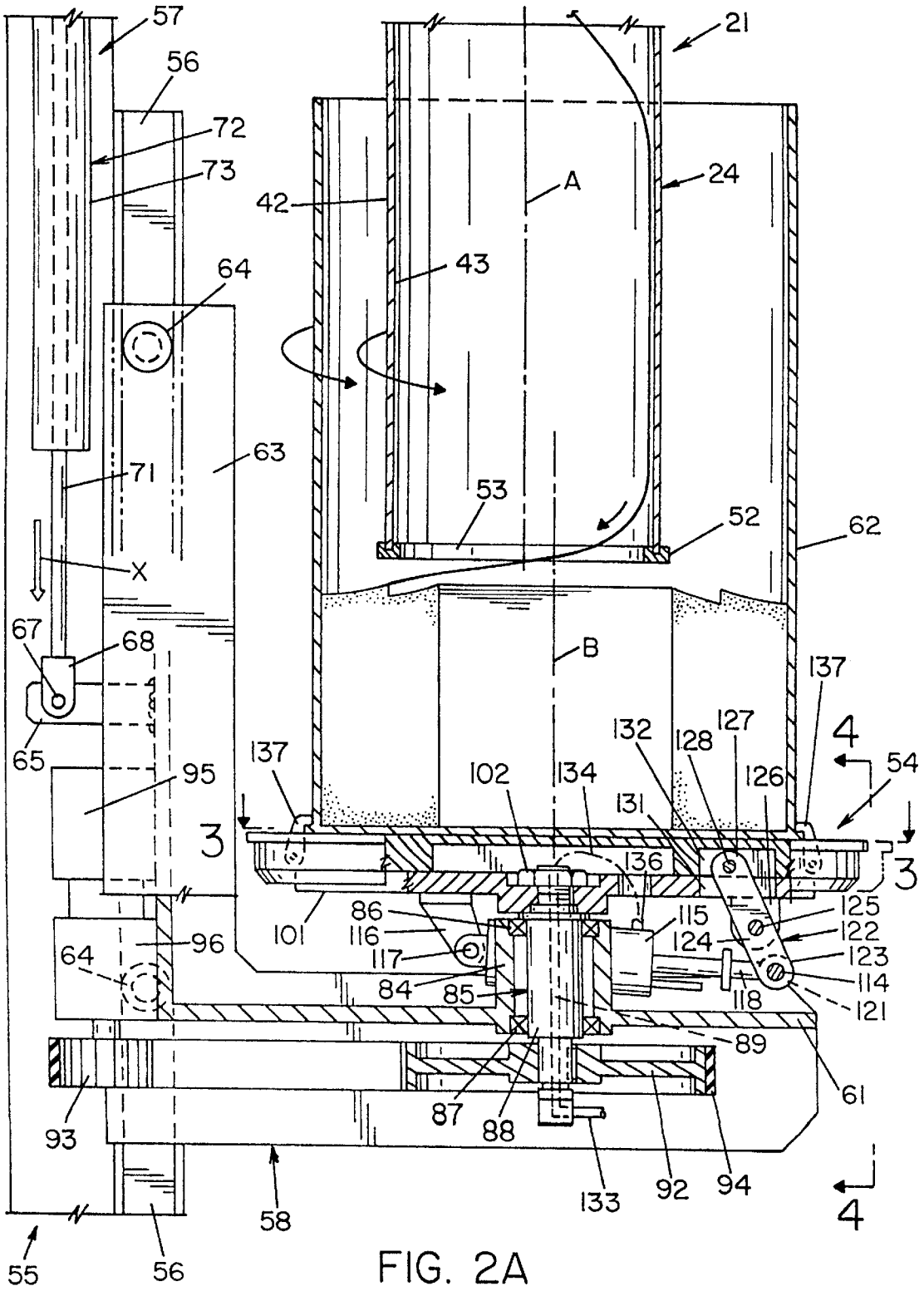
FIG. 2A is an elevation view showing the bottom half of FIG. 1.
Figure 2B:
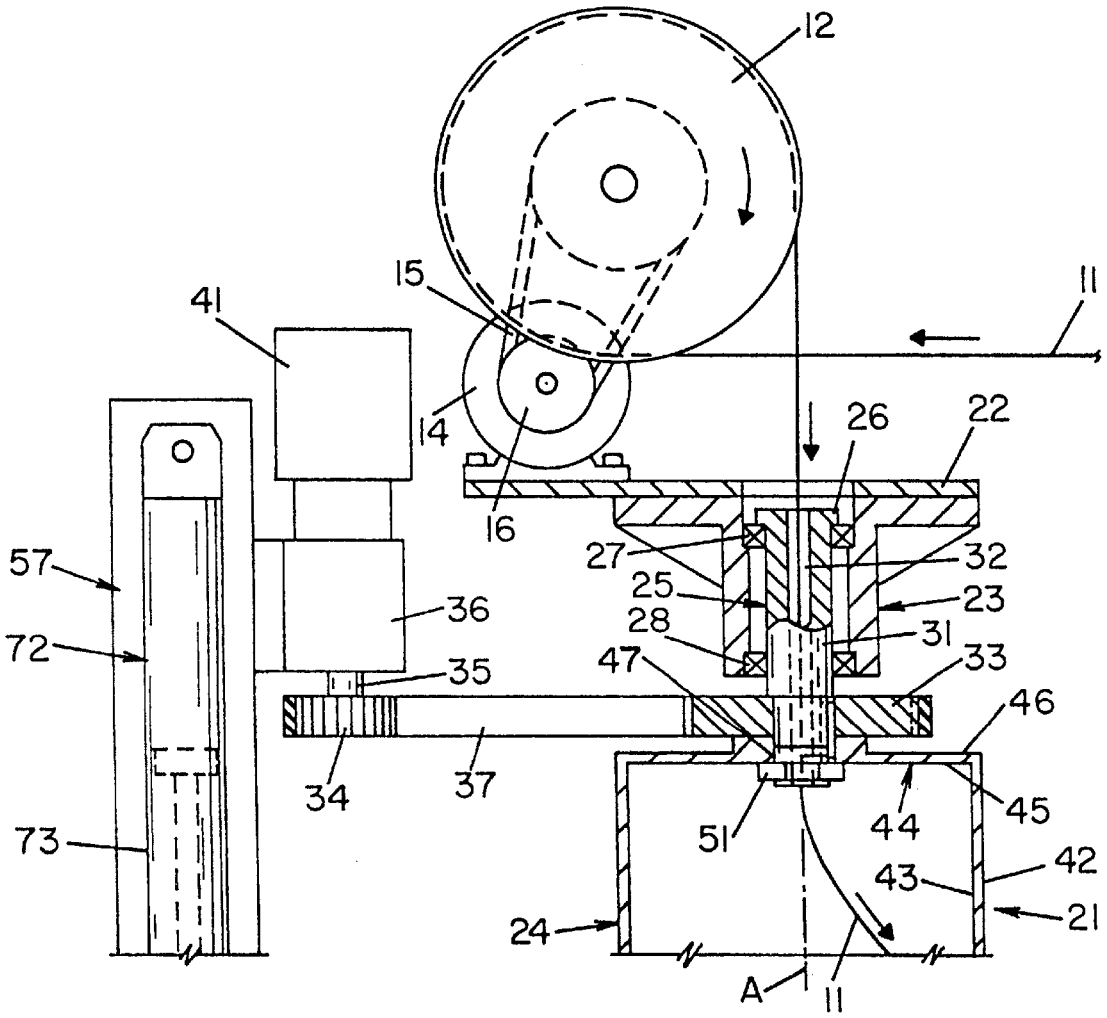
FIG. 2B is an elevation view showing the top half of FIG. 1.
Figure 3:
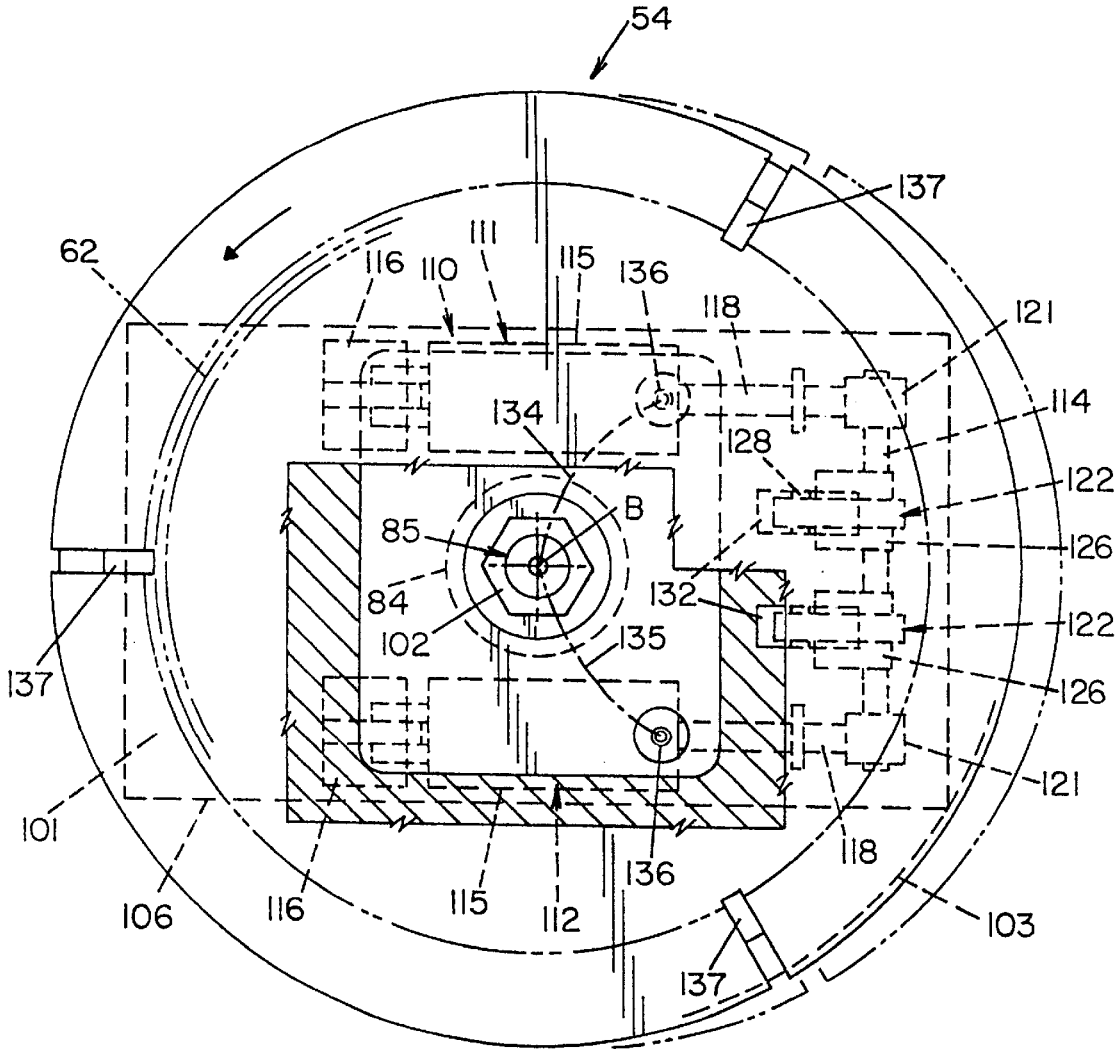
FIG. 3 is a plan view taking along line 3—3 of FIG. 2A.
Figure 4:
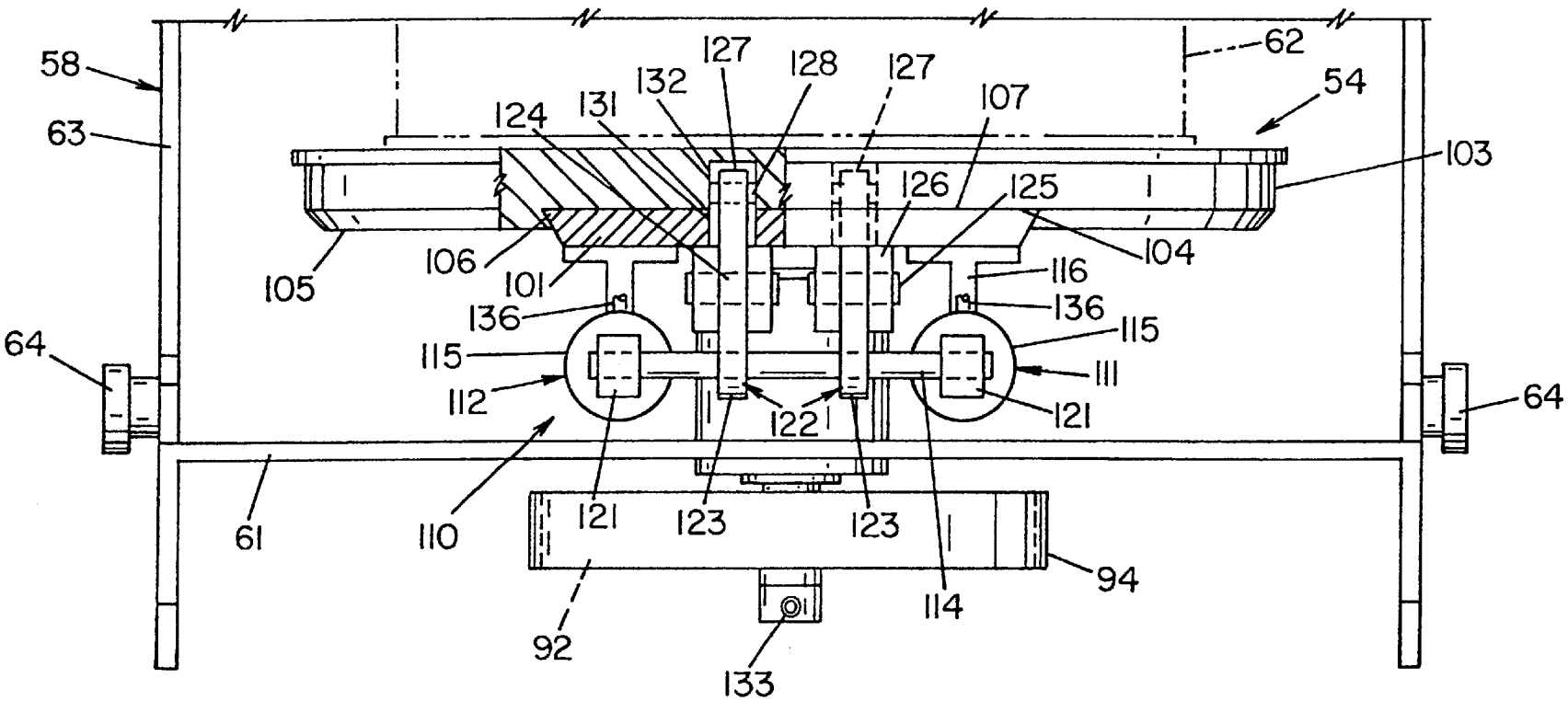
FIG. 4 is an elevation view of the turntable system taken along line 4—4 of FIG. 2A.

As can be best seen from FIG. 2A, FIG. 3 and FIG. 4, turntable 54 includes a bottom platform 101 which is driven for rotation by a top end key assembly 102 of journal portion 85. As best seen in FIG. 4, a slide table 103 is mounted on bottom platform 101 of turntable 54 by way of a large keyway 104 cut into the bottom end 105 of slide table 103.

A key 106 of bottom platform 101 retains slide table 103. Slide table 103 is capable of movement relative to bottom platform 101 by the sliding of keyway 104 on key 106. It will be appreciated that key 106 and keyway 104 can be coated with a relatively frictionless surface such as nylon or the like. Additionally, the bearing surface 107 of key 106 can be provided with a track and ball bearings or other type of bearings (not shown) which facilitates ease of movement between slide table 103 and bottom platform 101.

Movement of slide table 103 is caused by an indexer working in conjunction with slide table 103. Preferably, the indexer is a piston and cylinder assembly 110 which depends downwardly from turntable 54. Piston and cylinder assembly 110 includes two generally identical rod and pistons 111 and 112, respectively, which are commonly connected by a drive rod 114. Each of rod and pistons 111 and 112 are spaced apart an equal distance from journal portion 85 of turntable 54, and generally parallel to the direction of movement between key 106 and keyway 104 as shown in FIG. 3.

Figure 5:
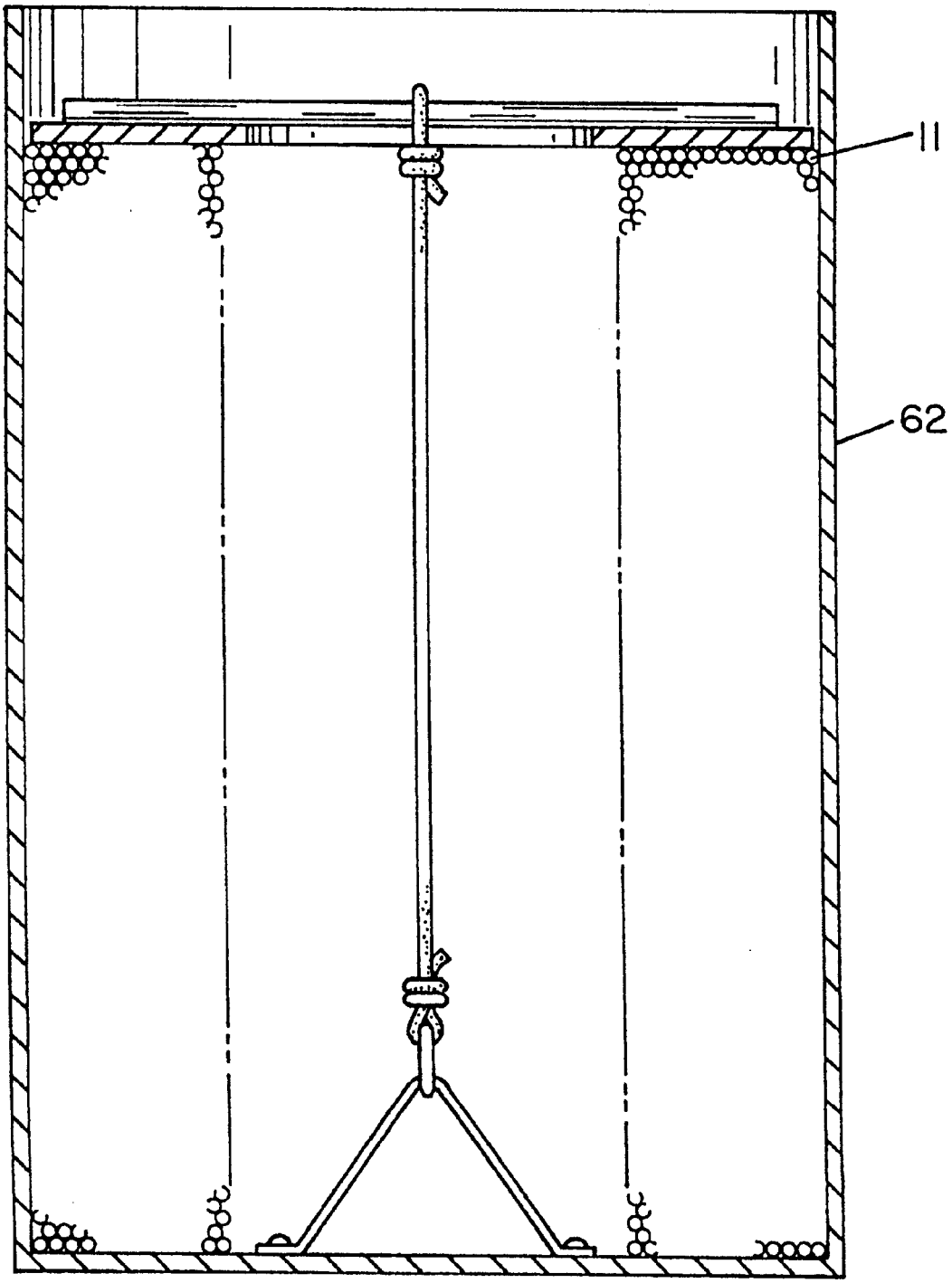
FIG. 5 shows a storage drum filled with welding wire in accordance with the present invention.

Rod and piston 111 will now be described. It will be appreciated that rod and piston 112 is identical and is numbered identically in the drawings. Rod and piston 111 includes piston portion 115 pivotally attached to bracket 116 which depends downwardly from bottom platform 101, by a pivot pin 117. Rod portion 118 extends from the opposite end of piston portion 115 to a block 121 which retains drive rod 114 therein. In turn, drive rod 114 extends generally perpendicular to rod portion 118 and is connected to identical block 121 extending from rod and piston 112. Between blocks 121, drive rod 114 is connected to a lever 122 at the lever lower end 123. At a middle portion 124 of lever 122, lever 122 is pivotally connected by a pin 125 to a bracket 126 extending from the bottom end of bottom platform 101. At an upper end portion 127 of lever 122, lever 122 is pivotally connected to slide table 103 by a pin 128. As can be best seen in FIG. 4, lever 122 is permitted to extend through bottom platform 101 to slide table 103 through aligned slots 131 and 132 in each of bottom platform 101 and slide table 103, respectively. Rod and pistons 111 and 112 are each driven equally by air. An air supply (not shown) is connected to air supply tube 133 at the bottom of journal portion 85. The inner cylinder surface 89 serves as an air passageway through which air supply is fed upwards to air supply hoses 134 and 135 (seen in FIG. 3) which are then connected to cylinder inlet 136. With the above arrangement, it will be appreciated that an air supply is capable of driving rod portion 118 of rod and pistons 111 and 112, which in turn drives lever 122 to move slide table 103 and keyway 104 in a horizontal direction relative to key 106 and bottom platform 101. The arrangement accomplishes this sliding movement without affecting the ability of turntable 54 and bottom platform 101 to rotate. A fully packed storage drum 62 is shown in FIG. 5.

The invention thus allows a storage drum 62 mounted on turntable 54 and specifically mounted with the clips 137 to slide table 103 be filled in accordance with the method as shown in FIGS. 9–13. As can be seen, welding wire 11 is placed within storage drum 62 by rotation of laying tube 24 about axis A. The rotation of laying tube 24 is shown by arrow C in FIGS. 9–11. It will be appreciated that laying tube axis A is offset from the centerline axis B of storage drum 62.

Figure 6:
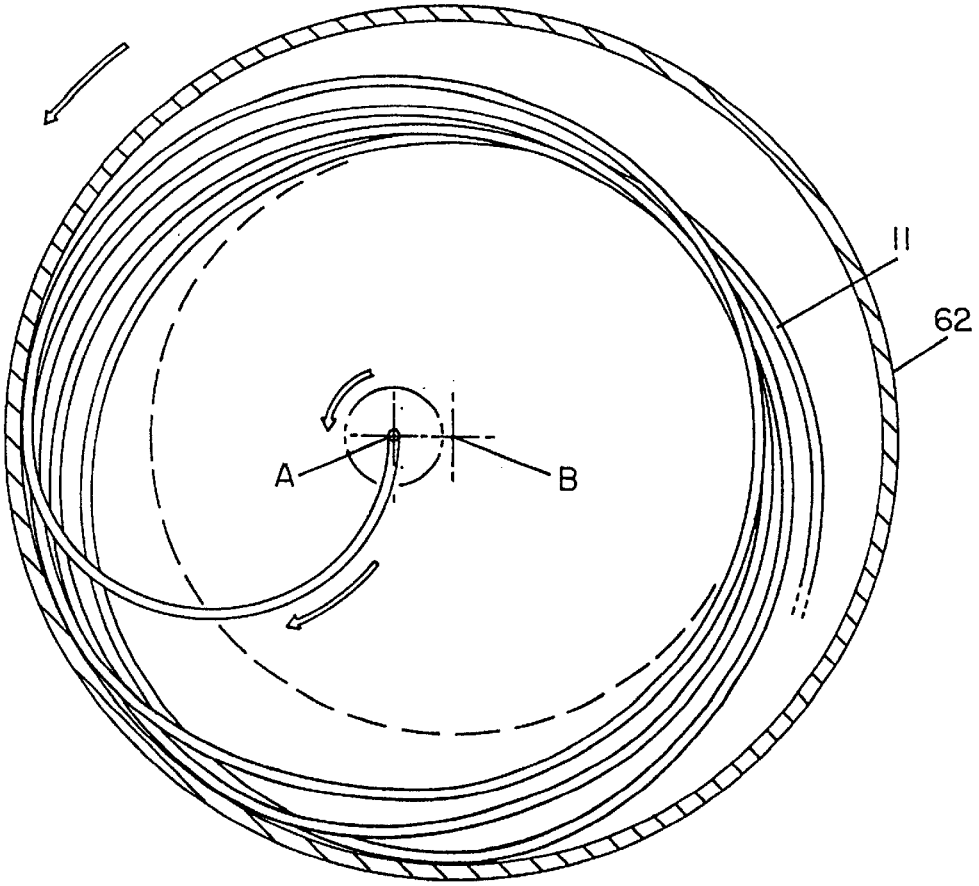
FIG. 6 (PRIOR ART)
FIG. 6 is a plan view showing the method of placement of welding wire as taught in the prior art.
Figure 7:
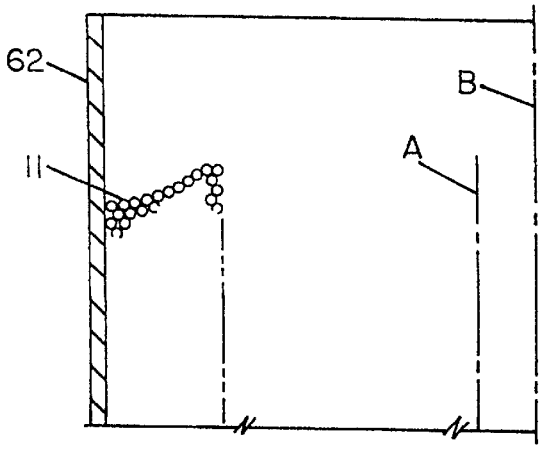
FIG. 7 (PRIOR ART)
FIG. 7 is a partial elevation view, in cross-section, showing the density variation of packed welding wire in the prior art.
Figure 8:
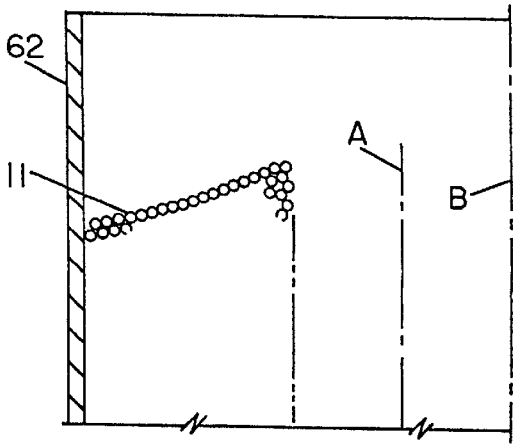
FIG. 8 (PRIOR ART)
FIG. 8 is a partial elevation view, in cross-section, showing the density variation of packed welding wire in the prior art.
Figure 9A:
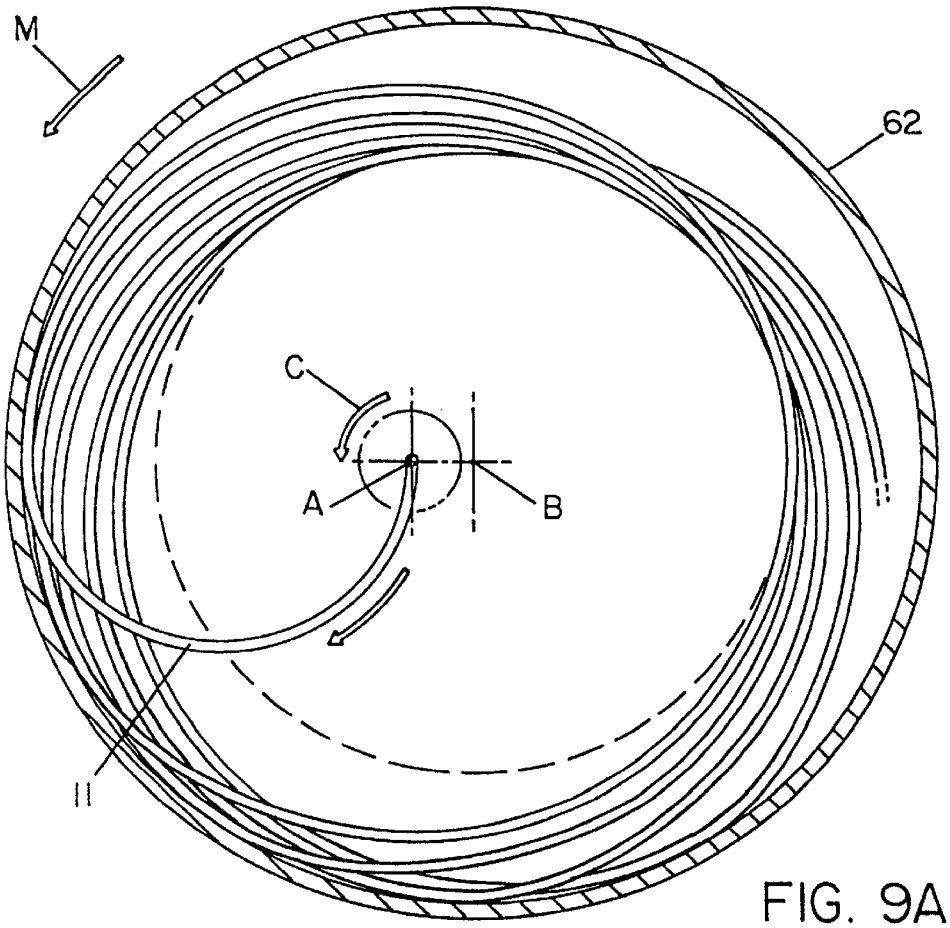
FIG. 9A and FIG. 9B show the steps in forming a single loop diameter layer in accordance with the present invention.
Figure 9B:
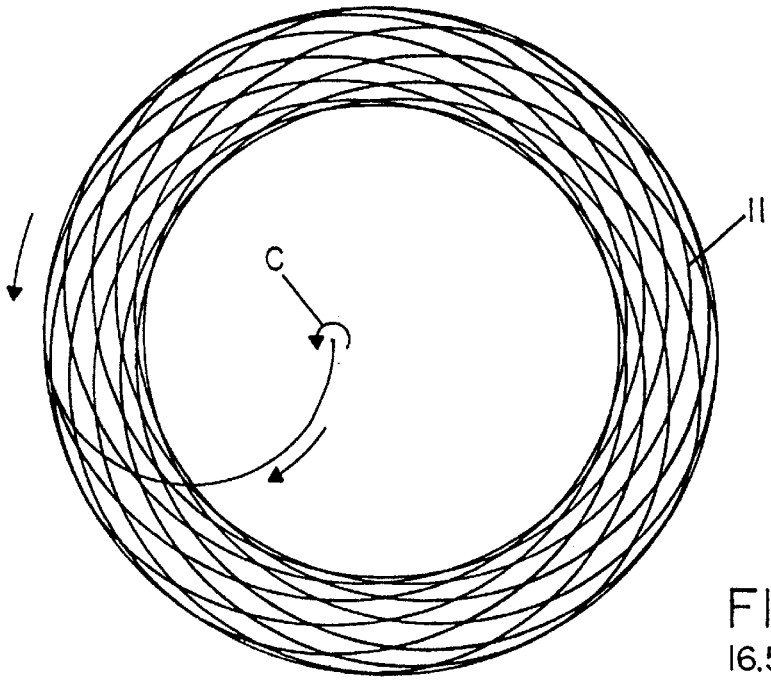
Figure 10A:
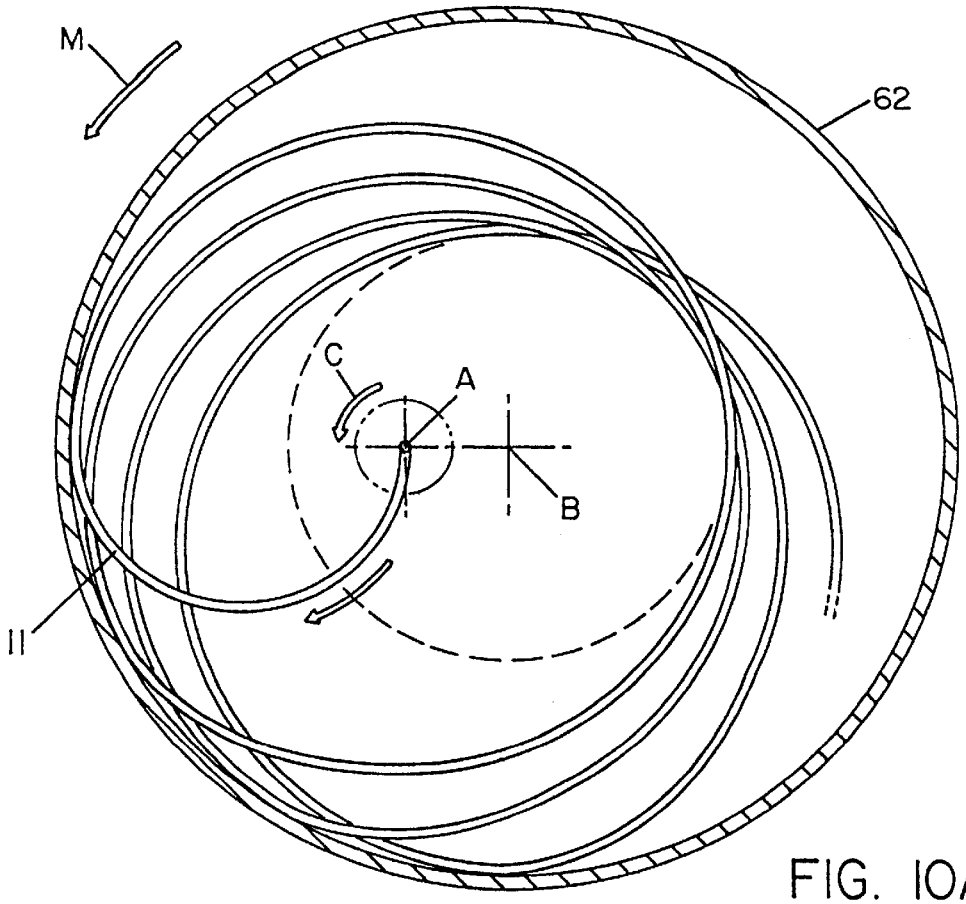
FIG. 10A and FIG. 10B are an additional example of the steps in forming a single loop diameter layer in accordance with the present invention.
Figure 10B:
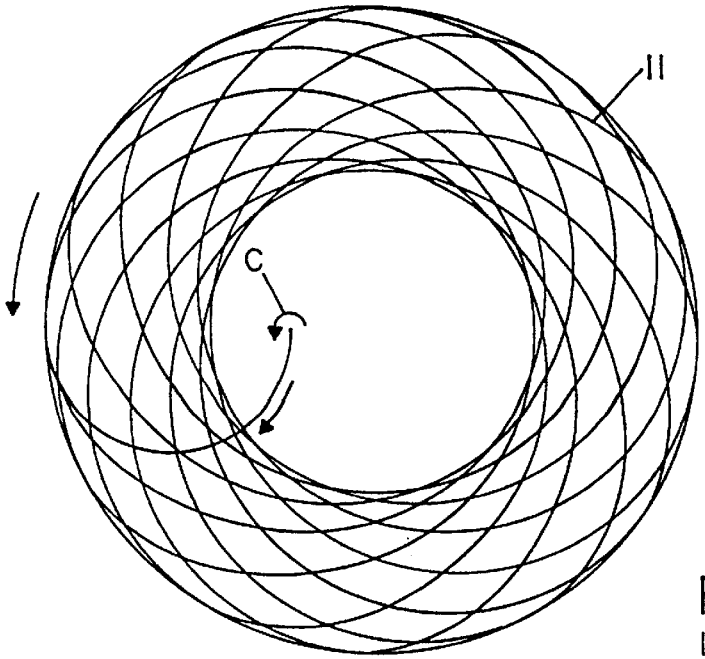

In one example, shown in FIGS. 9 and 10, a 20 inch storage drum 62 is used. With each single 360° revolution of laying tube 24, a 16.5 inch diameter loop of wire 11 is placed. Simultaneously, turntable 54 is caused to rotate a fraction of one revolution, preferably between one and two degrees, in the direction of rotation as shown by arrow M. The pattern developed within storage drum 62 is shown in FIG. 9B. After about 9–10 revolutions of storage drum 62, the loop diameter is changed. Using control panel 41, the relative rotational velocities of capstan 12 and rotatable laying head 21 are changed to change the loop diameter. As shown in FIGS. 10A and 10B, a 15.5 inch loop is placed in a full 360° layer, defined as one full revolution of turntable 54 during which laying tube 24 rotates about 323 times to place 323 15.5 inch loops. If the singular 16.5 inch coil (FIGS. 9A and 9B) or 15.5 inch coil (FIGS. 10A and 10B) were continued from the bottom to the top of storage drum 62, the cross-sectional pattern shown in FIG. 7 (for 16.5 inch coil) or FIG. 8 (for 15.5 inch coil) would be developed. The cross-sections of FIGS. 7 and 8, developed using the rotational method shown in FIG. 6, show a high density of welding wire at the extreme outer edges of storage drum 62 with less density towards the centerline axis B of storage drum 62.

Figure 11B:
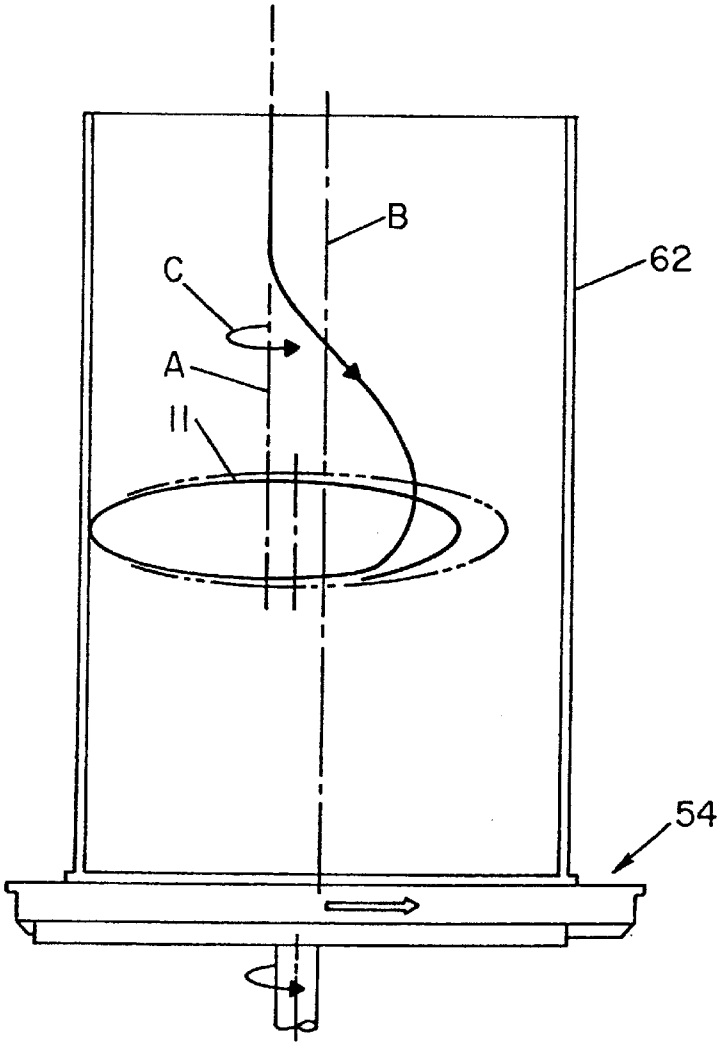
FIG. 11B is a schematic illustration showing the method of forming the loop diameter shown in FIGS. 10A and 10B.
Figure 11A:
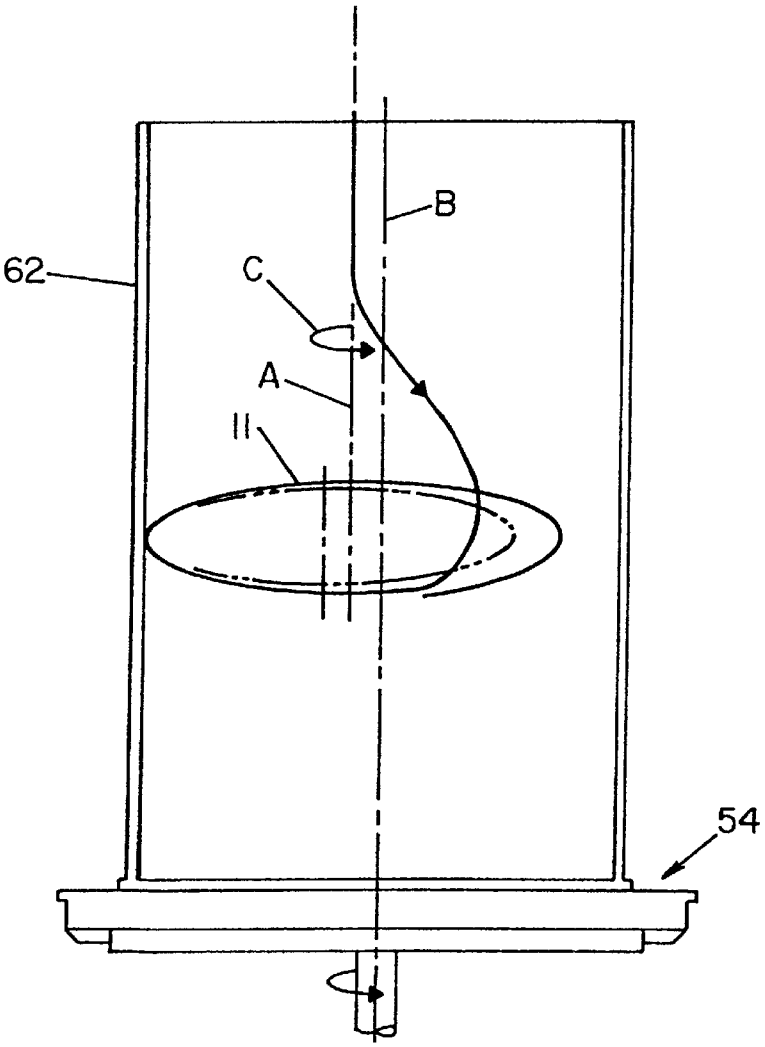
FIG. 11A is a schematic illustration of the method of forming the loop diameter shown in FIGS. 9A and 9B.

The present invention, and specifically rod and pistons 111 and 112, allow movement of centerline axis B of storage drum 62 relative to stationary centerline axis A of laying tube 24. As shown in FIGS. 11A and 11B, this movement, coupled with an adjustment of the ratio of the rotational velocity between capstan 12 and laying tube 24, changes the laying pattern within storage drum 62. Changing the loop diameter of welding wire 11 alone, without a corresponding shift in the centerline of storage drum 62, is not preferred, since the loop diameter should be sized to tangentially touch the inner surface of storage drum 62 at at least one point. Since welding wire 11 is somewhat "live," it will seek the inner surface even if not intentionally laid there. If its placement is less controlled, smooth withdrawal of the welding wire is not assured. The invention allows patterns such as those in FIGS. 9B and 10B to be developed.

Figure 12:
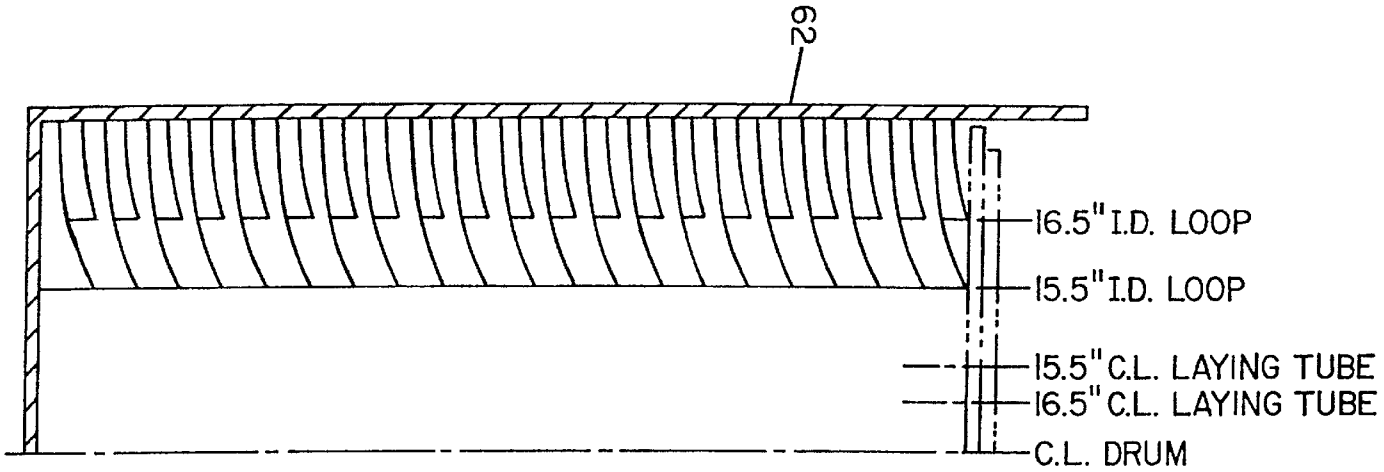
FIG. 12 is a partial elevation view, in cross-section, showing the affect of alternating layers of welding wire shown in FIGS. 9–11; and, FIG. 13 is a partial elevation view, in cross-section, showing another example of different layers of welding wire.
Figure 13:
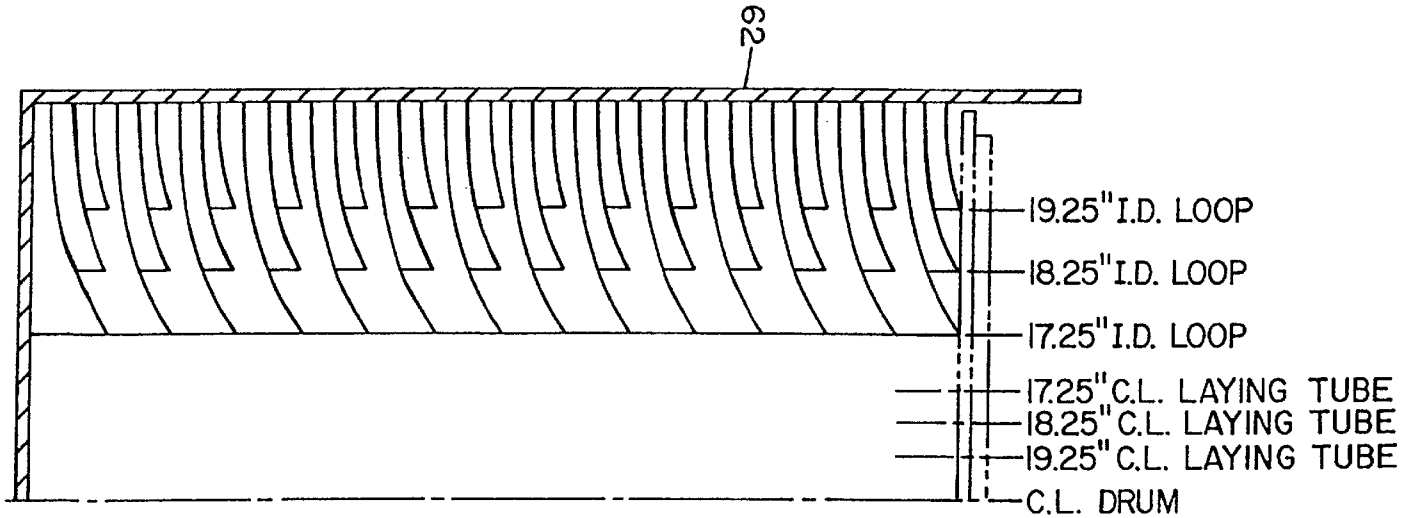

As shown in FIGS. 12 and 13, the invention uniquely provides for different loop diameters of welding wire 11 to be placed within storage drum 62. The placement of alternating layers of welding wire 11 having different loop diameters significantly increases the packing density within storage drum 62. It has been found that the packing density can be increased by upwards of 50% within the same volume storage container by placing 50% more wire within the same drum. FIG. 12 shows the example described in FIGS. 9–11, i.e. layers of welding wire within a storage drum 62 of 20 inch diameter. As can be seen, alternating layers of 16.5 inch loop diameter and 15.5 inch loop diameter are placed within the 20 inch drum. Since each loop diameter has a different density at points equidistant from the centerline of the drum, the differing densities and weights act to pack welding wire 11 more tightly within drum 62 and less void space is created within the same volume. FIG. 13 shows a second example with a 23 inch diameter drum in which a loop diameter is varied between 17.25, 18.25 and 19.25 inches. It will be appreciated that other patterns can be developed. The invention allows that the capacity of each storage drum 62 is increased by upwards of 50% from the prior art method and apparatus. It will be appreciated that the above examples can be modified. The optimum density is determined by the diameter of the drum and the loop diameter.

The invention has been described with reference to the preferred embodiment. Obviously, modifications and alterations other than those discussed herein will occur to those skilled in the art upon reading and understanding the specification. It is intended to include all such modifications insofar as they come within the scope of the invention.

What is claimed is:

1. A storage drum of densely packed welding wire comprising:

a storage drum having a bottom, an upper lip spaced axially apart from said bottom, and at least one side wall extending between said bottom and said upper lip; and, a continuous length of welding wire within said storage drum forming a plurality of axially adjacent layers, each of said axially adjacent layers being comprised of a number of wire loops having a nominal diameter forming a selected layer density, and each of said axially adjacent layers having a layer density substantially different than said axially adjacent layers immediately adjacent thereto.

2. The storage drum of claim 1, wherein each of said axially adjacent layers is comprised of a number of circumferentially adjacent wire loops.

3. The storage drum of claim 2, wherein said layer density of each of said axially adjacent layers is selected by said number of wire loops thereof having one of two nominal diameters.

4. The storage drum of claim 3, wherein said at least one side wall of said storage drum has an inner surface, and each of said number of wire loops of each of said axially adjacent layers touches said inner surface at least at one point along said inner surface.

5. The storage drum of claim 4, wherein said storage drum is cylindrical.

6. The storage drum of claim 2, wherein said layer density of each axially adjacent layer is selected by said number of wire loops thereof having one of at least three nominal diameters.

7. The storage drum of claim 6, wherein said at least one side wall of said storage drum has an inner surface, and each of said number of wire loops of each of said axially adjacent layers touches said inner surface at least at one point along said inner surface.

8. The storage drum of claim 7, wherein said storage drum is cylindrical.

9. A storage drum of densely packed welding wire comprising:

a storage drum having a bottom, an upper lip spaced axially apart from said bottom, and at least one side wall extending between said bottom and said upper lip; and, a continuous length of welding wire within said storage drum placed into a plurality of axially adjacent layers, each of said axially adjacent layers being comprised of a number of wire loops, each of said number of wire loops being formed from a discrete length portion of said continuous length of welding wire, said number of wire loops and said discrete length portion thereof forming a layer density for each of said axially adjacent layers, and each of said axially adjacent layers having a layer density substantially different than said axially adjacent layers immediately adjacent thereto.

10. The storage drum of claim 9, wherein each of said number of wire loops of each of said axially adjacent layers are circumferentially adjacent.

11. The storage drum of claim 10, wherein said discrete length portion of all of said circumferentially adjacent wire loops of each of said axially adjacent layers has one of two nominal lengths.

12. The storage drum of claim 11, wherein said at least one side wall of said storage drum has an inner surface, and each of said number of wire loops of each of said axially adjacent layers touches said inner surface at least at one point along said inner surface.

13. The storage drum of claim 10, wherein said discrete length portion of all of said circumferentially adjacent wire loops of each of said axially adjacent layers has one of three nominal lengths.

14. The storage drum of claim 13, wherein said at least one side wall of said storage drum has an inner surface, and each of said number of wire loops of each of said axially adjacent layers touches said inner surface at least at one point along said inner surface.

15. A storage drum of densely packed welding wire comprising:

a storage drum having a bottom, an upper lip spaced axially apart from said bottom, and at least one side wall extending between said bottom and said upper lip; and, a continuous length of welding wire within said storage drum placed into a plurality of axially adjacent layers, each of said axially adjacent layers being comprised of a number of wire loops with all of said number of wire loops in each of said axially adjacent layers having a uniform loop diameter, and said specified number of wire loops of each of said axially adjacent layers having a uniform loop diameter different from said axially adjacent layers immediately adjacent thereto.

16. The storage drum of claim 15, wherein each of said number of wire loops of each of said axially adjacent layers are circumferentially adjacent.

17. The storage drum of claim 16, wherein each of said uniform loop diameters is one of two nominal loop diameters.

18. The storage drum of claim 16, wherein each of said uniform loop diameters is one of three nominal loop diameters.

19. A storage drum of densely packed wire comprising:

a storage drum having a bottom, an upper lip spaced axially apart from said bottom, and at least one side wall extending between said bottom and said upper lip; and, a continuous length of wire placed in a plurality of loops within said storage drum, said loop forming a plurality of axially adjacent striated layers within said storage drum, all of said loops forming each striated layer having one of two uniform nominal loop diameters, and each of said plurality of axially adjacent striated layers being formed by said loops having a uniform nominal loop diameter different than said loops forming said axially adjacent striated layers immediately adjacent thereto.

20. The storage drum of claim 19, wherein each of said plurality of loops are circumferentially adjacent one another.

21. The storage drum of claim 20, wherein said at least one side wall of said storage drum has an inner surface, and each of said plurality of loops within said storage drum touches said inner surface at at least one point.

22. The storage drum of claim 21, wherein said storage drum is cylindrical.

23. A storage drum of densely packed wire comprising:

a storage drum having a bottom, an upper lip spaced axially apart from said bottom, and at least one side wall extending between said bottom and said upper lip; and, a continuous length of wire placed in a plurality of loops within said storage drum, said loop forming a plurality of axially adjacent striated layers with said storage drum, all of said loops forming each striated layer having one of at least three uniform nominal loop diameters, and each of said plurality of axially adjacent striated layers being formed by said loops having a uniform nominal loop diameter different than said loops forming said axially adjacent striated layers immediately adjacent thereto.

24. The storage drum of claim 23, wherein each of said plurality of loops are circumferentially adjacent one another.

25. The storage drum of claim 24, wherein said at least one side wall of said storage drum has an inner surface, and each of said plurality of loops within said storage drum touches said inner surface at at least one point.

26. The storage drum of claim 25, wherein said storage drum is cylindrical.

27. A storage drum of densely packed wire comprising:

a storage drum having a bottom, an upper lip spaced axially apart from said bottom, and at least one side wall extending between said bottom and said upper lip; and, a continuous length of wire placed in a plurality of loops within said storage drum, said loop forming a plurality of axially adjacent striated layers with said storage drum, all of said loops forming each striated layer having one of two discrete length portions of said continuous length of wire, and each of said plurality of axially adjacent striated layers being formed by said loops having a uniform nominal loop diameter different than said loops forming said axially adjacent striated layers immediately adjacent thereto.

28. The storage drum of claim 27, wherein each of said plurality of loops are circumferentially adjacent one another.

29. The storage drum of claim 28, wherein said at least one side wall of said storage drum has an inner surface, and each of said plurality of loops within said storage drum touches said inner surface at at least one point.

30. The storage drum of claim 29, wherein said storage drum is cylindrical.

31. A storage drum of densely packed wire comprising:

a storage drum having a bottom, an upper lip spaced axially apart from said bottom, and at least one side wall extending between said bottom and said upper lip; and, a continuous length of wire placed in a plurality of loops within said storage drum, said loop forming a plurality of axially adjacent striated layers with said storage drum, all of said loops forming each striated layer having one of at least three discrete length portions of said continuous length of wire, and each of said plurality of axially adjacent striated layers being formed by said loops having a uniform nominal loop diameter different than said loops forming said axially adjacent striated layers immediately adjacent thereto.

32. The storage drum of claim 31, wherein each of said plurality of loops are circumferentially adjacent one another.

33. The storage drum of claim 32, wherein said at least one side wall of said storage drum has an inner surface, and each of said plurality of loops within said storage drum touches said inner surface at at least one point.

34. The storage drum of claim 33, wherein said storage drum is cylindrical.

* * * * *